United States Patent [19]

Christian

[11] Patent Number: 4,664,034

[45] Date of Patent: May 12, 1987

[54] FETTERED SHOT

[76] Inventor: Dale W. Christian, 1110 Sandler, NE., Albuquerque, N. Mex. 87112

[21] Appl. No.: 726,446

[22] Filed: Apr. 23, 1985

[51] Int. Cl.[4] ..... F42B 7/02

[52] U.S. Cl. ..... 102/457; 102/439; 102/489

[58] Field of Search ..... 102/448-463, 102/430, 438, 439, 501, 506, 489, 504

[56] References Cited

U.S. PATENT DOCUMENTS

| | | | |
|---|---|---|---|
| 175,400 | 3/1876 | Wilkinson . | |
| 347,988 | 8/1886 | Boyd . | |
| 1,151,070 | 8/1915 | Victory . | |
| 1,198,035 | 9/1916 | Huntington . | |
| 1,537,291 | 5/1925 | Couter . | |
| 1,575,716 | 3/1926 | Pavek | 102/460 |
| 2,296,980 | 9/1942 | Carmichael | 102/63 |
| 2,308,683 | 1/1943 | Forbes | 102/89 |
| 2,322,624 | 6/1943 | Forbes | 102/89 |
| 2,352,502 | 6/1944 | Smith | 102/89 |
| 2,354,451 | 7/1944 | Forbes | 102/38 |
| 2,759,420 | 8/1956 | Schultz | 102/42 |
| 3,085,510 | 4/1963 | Campell | 102/456 |
| 3,721,194 | 3/1973 | Weston, Jr. | 102/42 |
| 3,760,735 | 9/1973 | Schmitt | 102/87 |

FOREIGN PATENT DOCUMENTS

| | | | |
|---|---|---|---|
| 534130 | 3/1958 | Italy | 102/438 |
| 23196 | 11/1915 | United Kingdom | 102/505 |

OTHER PUBLICATIONS

*Try Tailed Round Balls,* by Dick Eades, Shooting Times, Jul. 1975, pp. 58, 59.

*Primary Examiner*—Harold J. Tudor
*Attorney, Agent, or Firm*—James E. Snead

[57] ABSTRACT

A cartridge for use in firearms contains fettered shot therein. The fettered shot enables eight or more pellets to be discharged in a tight group and in a manner which increases the effective range of the firearms. The fettered shot of the present invention is especially useful against helicopters and airborn troop assaults.

5 Claims, 9 Drawing Figures

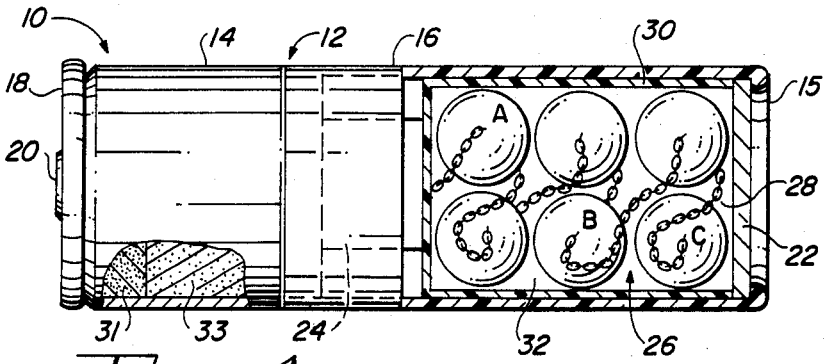
FIG. 1
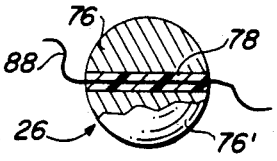
FIG. 7
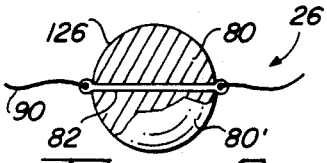
FIG. 8
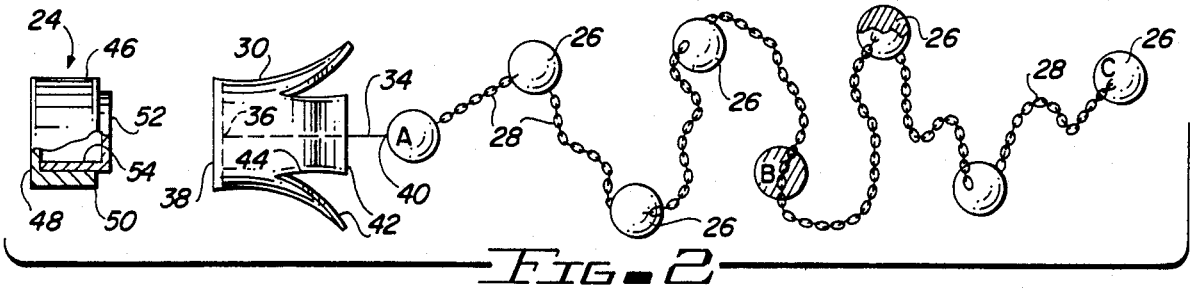
FIG. 2
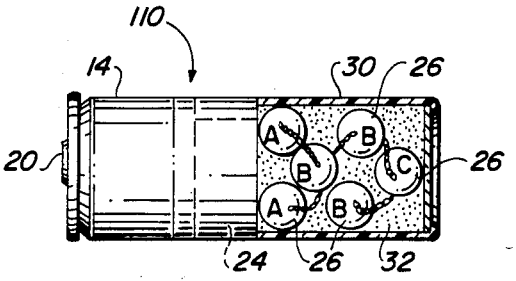
FIG. 3
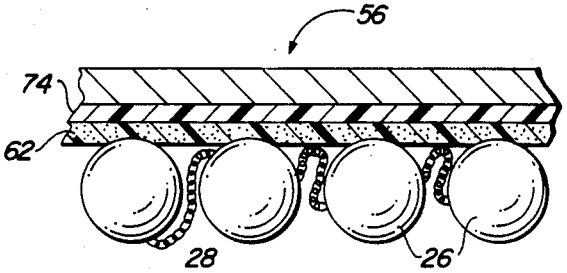
FIG. 6
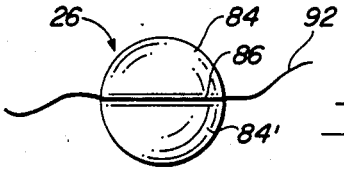
FIG. 9
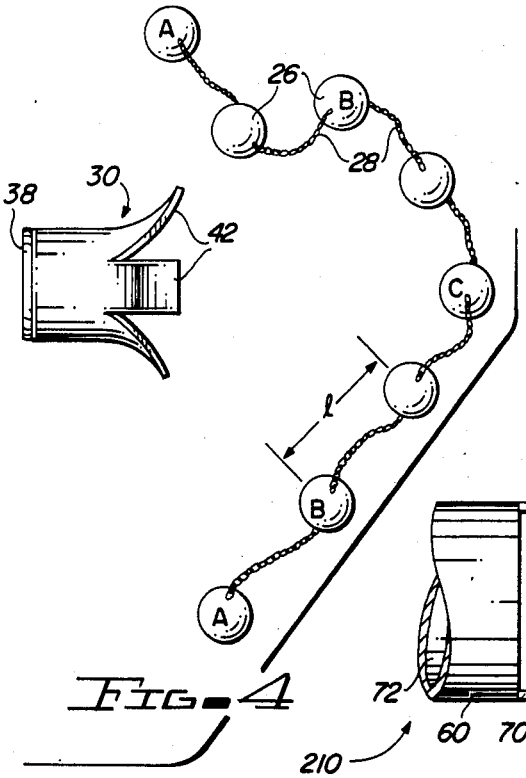
FIG. 4
FIG. 5
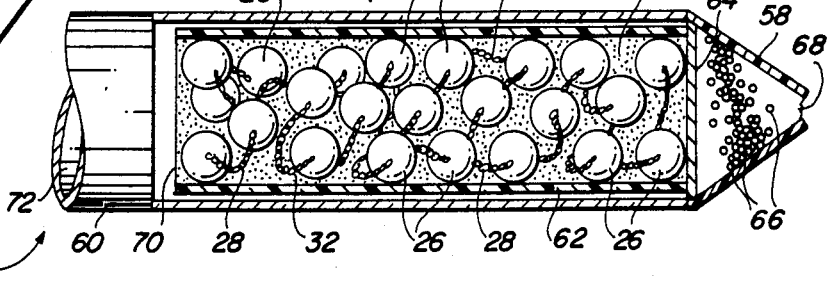

FETTERED SHOT

BACKGROUND OF THE INVENTION

This invention relates to the extension of the effective killing range of a shotgun in close-quarter combat, night combat, and to offer the infantryman an effective weapon to kill, or disable, enemy helicopters and slow flying light aircraft, and for use against parachute drops. This cartridge could be made effective in repelling mass troop assaults, helicopter attacks, and parachute troop-/equipment drops when used in conjunction with heavy caliber high velocity automatic weapons.

Presently, ground troops attempt to knock out helicopters with semi-automatic and automatic rifle fire directed to the rear rotor area of a helicopter. The velocity and size of rifle projectiles make this feat difficult to accomplish. The strung-out fettered shot group of this invention will entangle or damage the helicopter rotors and cut control cables at much higher percentages as compared to conventional ball type rifle ammunition.

The shell of this invention, when used in mounted high velocity smooth-bore guns, would be effective in knocking out helicopters in flight by firing the fettered shot through the rotors or through other sensitive parts of the machine.

The use of the fettered shot in either shoulder fired or a mounted gun would be effective for use against troop and equipment parachute drops. The long fettered shot group can be used to cut or entangle parachute cords or tear large holes in the parachute canopies, thus dropping the troops, or cargo, to the ground well ahead of their normal release point, thereby causing injury, death, or extensive damage.

One version of a cartridge shown and described herein can be used in rifled artillery as well as in smooth-bore tank mounted guns of various caliber. When mounted on tanks, such a gun would provide an economic anti-helicopter device. This shot would have a longer range as compared to flachette loads and accordingly could be advantageously used on the above described pieces to repel an overrun, for example. Moreover, the fettered shot of this invention would more likely disable light motorized vehicles as compared to the prior art flachette load used in present artillery shells such as the bee-hive round, for example.

A cartridge of high velocity using the fettered shots of this invention would be effective against repelling mass troop attacks, and would be highly effective in night combat when soldiers cannot see their gun sites. Thus, this cartridge would be ideal for use in the new close assault weapons system (CAWS) recently developed by the U. S. Navy under the Joint Service Small Arms Program (JSSAP).

The psychological effect of a cartridge made in accordance with this invention when used on enemy troops is of considerable value.

SUMMARY OF THE INVENTION

An improved cartridge, or round of ammunition, for use in shotguns, cannons, and other firearms. The cartridge includes a shotcup within which a plurality of shot are housed. The shot are attached to one another by a length of relative small diameter line, flexible cable, or chain.

An explosive charge, when detonated, discharges the shotcup from the cartridge shell.

The manner in which the shot are grouped together and loaded in the shell determines the pattern assumed by the discharged shot. In one form of the invention, the shot are tied together in series relationship by a relatively strong length of material. A last shot of the series of shot is tied to the shotcup by a relatively weak length of material. The shot, when discharged from the gun, are strung out in a line having a very low frontal area. The aerodynamic drag of the shotcup causes the weak length of material to break and thereby releases the shot from the shotcup. The tie feature serves to string the shot group out much quicker.

The prior art plastic shotcup serves to protect the gun barrel from the steel chain connecting the pellets.

A primary object of the present invention is the provision of improvements in cartridges for firearms, and in particular to provide cartridges for firearms which have an unexpected improved effective range.

Another object of this invention is the provision of a cartridge or shell having fettered shot contained therein and arranged wherein at extreme ranges, the object struck is hit by a mass of over 430 grains, since the shot is tied together, as opposed to 53.8 grains for one pellet of a conventional shotgun shell.

A further object of this invention is to provide an artillery shell within which a plurality of fettered shot are arranged in a manner to produce an unusually destructive pattern.

A still further object of this invention is the provision of a cartridge having a plurality of shot housed therein which are discharged in a pattern which greatly enhances the destructive result achieved upon impact.

An additional object of this invention is the provision of a new combination of elements which discharges fettered shot from a weapon in a new and unobvious manner to thereby increase the effective range of the weapon.

These and various other objects and advantages of the invention will become readily apparent to those skilled in the art upon reading the following detailed description and claims and by referring to the accompanying drawings.

The cartridge of the present invention would greatly enhance the combat flexibility of the Close Assault Weapons System (CAWS), particularly when the fettered shot is used with the CAWS ammunition of ultra-high velocity developed by Winchester Gun.

The above objects are attained in accordance with the present invention by the provision of a combination of elements which are fabricated in a manner substantially as described in the above abstract and summary.

BRIEF DESCRIPTION OF THE DRAWINGS

FIG. 1 is a side elevational view of a cartridge made in accordance with the present invention, with some parts being broken away therefrom so as to disclose the interior thereof;

FIG. 2 is an exploded view of part of the apparatus disclosed in FIG. 1;

FIG. 3 is a side elevational view of another embodiment of the present invention, with some parts being broken away therefrom so as to disclose the interior thereof;

FIG. 4 is an exploded view of part of the apparatus disclosed in FIG. 3;

FIG. 5 is a fragmentary, part cross-sectional, side elevational view of a large caliber cannon shell made in accordance with the present invention;

FIG. 6 is an enlarged, fragmentary, detail of part of the shell disclosed in FIG. 5; and, FIGS. 7, 8, and 9 set forth various different embodiments of part of the apparatus disclosed in the foregoing figures.

DETAILED DESCRIPTION OF THE PREFERRED EMBODIMENTS

In FIG. 1, there is disclosed a cartridge 10, made in accordance with the present invention. The cartridge 10 is of a 12 gauge size and includes an external housing 12 having a brass head 14 at the rear marginal end thereof within which a cylindrical plastic part 16 is received in fixed relationship thereto. The rear face 18 of the cartrige has the usual primer 20 centrally located thereon. A closure member 22 is located in opposition to member 18 at the exit or front end of the cartridge or a conventional (prior art) crimp may be utilized. A shock absorber 24 (prior art) is located rearwardly of a plurality of shot 26. Between the shock absorber 24 and the primer 20 is a conventional charge of prior art explosive. The shot 26 are attached to one another by a length of chain 28. The shot and chain are contained within an outwardly shotcup 30 that serves to protect the gun barrel from the steel chain. Fine plastic powder, such as 150 mesh ground teflon (T.M.), fills the void between the shot and chain to protect the shot during handling and transport.

As best seen illustrated in FIG. 2, together with FIG. 1, the shot 26 is comprised of a last shot A, a first shot C, and a plurality of intermediate shots B. The shots each are connected to one another by the before mentioned chain 28, with the total length of the chain preferably being about 12 inches for the 12 gauge case. A one pound test or weaker breakaway line 34 is attached at 36 to the interior surface of the end wall 38 of the shotcup 30. The illustration of FIG. 2 shows the cartridge of FIG. 1 upon firing or detonation.

The shotcup 30 (prior art) comprises a plurality of tabs 42 formed by opposed longitudinal edges 44 which separate the skirt-like outwardly opening marginal end of the shotcup into the illustrated circumferentially spaced tabs 42. The tabs 42 are forced into the outwardly curved illustrated position of FIG. 2 because of air friction or aerodynamic drag. The shock absorber 24 has a main cylindrical body portion 46 in the form of a cup which includes a rear wall circumferentially encompassed by integral skirt member 50. A piston 52 in the form of an inverted cup includes a circumferentially extending wall 54 made complementary respective to the skirt member 50 of the main body so that the piston can be slidably forced into the main body.

Throughout the remainder of this disclosure, wherever it is convenient or appropriate to do so, like or similar numerals will refer to like or similar elements.

FIGS. 3 and 4 of the drawings set forth another embodiment of the present invention, wherein the arrangement of the shot 26 stored within the cup 30 is different from the embodiment set forth in FIGS. 1 and 2. The shot 26 are attached to one another by attachment means 28 illustrated herein as a length of metal chain. A center shot C is arranged respective to the other shot A and B, whereby the center shot C leads the other shot and the last shot A, located along the chain 28, trails behind the shot B and C in the illustrated manner of FIG. 4.

The length L between adjacent shot within the chain 28 preferably is placed on approximate two inch centers for a size 30 caliber shot, for example. This spacing of adjacent shot is determined by dividing the shot diameter by 0.15 to 0.20. Hence, a 5/8" case should have 3" to 4" spacing, while a 30 caliber case should have 1½" to 2" spacing. This novel spacing is important for it allows the mass of the shot to compensate for the aerodynamic drag of the chain, or other connector, to allow an effective pattern to develop, and thereby provides unexpected results.

FIG. 5 illustrates a heavy caliber shell for use by artillery and the like. The shell has an outer housing 56 which is crimped or otherwise closed at 58. The housing can be a brass case 60. A cylindrical foam pad 62 is cut to provide tabs in a manner similar to the cup 30 of FIG. 4. The pad isolates the shot 26, chain 28, and plastic powder 32 from the hollow interior of the case 60. The foam pad 62 further protects a rifled cannon barrel from undue wear. Paper wad 64 separates the main shot 26 from the smaller soft lead shot 66 which fills the hollow cone at the forwardmost end 68 of the case. Numeral 70 illustrates the rear wall of the shot chamber. Explosive material is placed within the chamber 72 of the shell.

As seen in FIG. 6, the entire fettered shot group is housed within a thin-mallable copper sleeve, 74, which is cut longitudinally to provide tabs, much in the manner of the plastic shot cup, 30, in FIG. 4. The copper sleeve, which drops due to air friction after firing, facilitates the missle exiting the gun barrel.

In FIG. 6, the foam plastic sleeve 62 isolates the shot 26 from the interior wall surface of the case 56. The shot 26 are connected one to the other in series relationship by means of the connector 28, illustrated herein as being in the form of a light weight, high strength, chain. The chain can be made of 0.065 diameter steel having 0.25" mean diameter oblated loop, with there being 3 to 4 inches of chain between each adjacent shot for a 5/8" diameter case 56.

Where deemed desirable, the grouping can be controlled by arranging the shot in groups of three or four, with the shot of each group being connected by an individual chain 28, to thereby provide a plurality of fettered shot, where the individual groups are not connected one group to the other group.

In FIGS. 5 and 6, the soft lead shot 66 will form a larger pattern as compared to the groups of fettered shot 26. This provides a dual group of small and large patterned shot because the free lead shot 66 will assume a larger diameter pattern having a shorter range, while the fettered shot 68 will have a longer range, more accuracy, and more effective killing power due to the mass of the groups (3–4 pellets per chain). The intention of this dual load is for use when enemy troops are overrunning an artillery position. The loose shot, 66, will have an effective short range killing pattern while the groups of fettered shot, 26, will have an effective killing range to the limits of the gun's capability.

In FIG. 7, a method of connection is shown. Pellets have a hole molded through the center. After a line 88 is run through a group of pellets, they are secured to the line with an epoxy-like glue, 78.

In FIG. 8, the shot 26 is comprised of hemispherical members 80, 80' having a pin 82 molded through the center thereof, with the opposite looped ends of the pins being provided with the illustrated eyelet to which a connector line or chain 90 is attached. The connector line 90 is a monofilament line or stainless steel chain. The desired line, or chain, diameter is determined by dividing the shot diameter in inches by the values 2.4 to 1.6 which will yield the approximate range for the line, or chain, diameter.

In FIG. 9, the shot 26 comprises hemispheres 84, 84' having a thread-like connector line 92 interposed therein. The hemispheres 84, 84' are compressed into essentially a unitary ball of shot, in the manner of split shot used on fishing line, while the string or line 92 is located therewithin. The preferred connection 28 is a steel chain, the diameter of which is determined according to the above examples. The configuration of the chain or connectors 88, 90, and 92 depends upon the shell caliber.

It is further contemplated to mold a plurality of shot having a connector contained within the mold cavity by providing a split mold having a plurality of cavities therewithin, with the steel chain 88, 90, or 92 being aligned through the center of the mold cavity during the molding or casting process.

OPERATION

In operation, the first embodiment of the invention as disclosed in FIGS. 1 and 2 preferably is loaded into a conventional 12 gauge shotgun shell 12. The shot is 00buckshot, which is approximately .30 caliber. The steel chain spaces the shot on approximately 2" centers. The steel chain is approximately 1/8" mean diameter oblated loop made up of 0.60" diameter stainless steel wire forged or welded into a continuous loop. Jewelry chain, made of stainless steel, for example, can be advantageously used.

The cap 20 and the explosive contained within the brass part of the shell are conventional, commercially available, and known to those skilled in the art.

The prior art shock absorber 24 can be made of inexpensive plastic, for example polyethylene, nylon, or the like, and is commercially available. The prior art shock absorber 24 protects the shot from deformation, and may be omitted where it is desired to increase the number of fettered shot or the quantity of the explosive charge.

In the embodiment seen in FIGS. 1 and 2, the shot cup 30 provides aerodynamic drag to the discharged fettered shot and causes the shot A, B, C to be strung out in series relationship, thereby providing a minimal frontal area to wind resistance, and effectively increases the range, particularly in ultra-high velocity shells.

The arrangement of the shot A, B, C in FIG. 3 causes the fettered shot to assume the pattern illustrated in FIG. 4.

This invention provides the combat infantryman with increased capability to kill or disable enemy helicopters and light aircraft when using a shoulder-held semi-automatic or fully automatic weapon. The invention provides an improved weapon intended for use against ground troops (or in similar police situations) giving kill or disabling power effective between the ranges of pistols and rifles. The invention provides a weapon which is not as sensitive as pistols or rifles to accurate sighting. The cartridge, or shell, regardless of caliber or mode of fire (semi or full automatic), would be a highly effective night or jungle combat weapon. Further, upon hitting the ground or partially contacting a target, the shot string whips creating a highly psychological missile.

Various caliber of the fettered shot will be highly effective in repelling an enemy parachute drop. The fettered shot shell when used with high velocity automatic weapons mounted on jeeps will be ideal for defending bridges, passes, and the like, against night or day helicopter and airborne troop assaults.

The unique design of the cartridge offers greater accuracy under stress situations than a pistol or rifle due to the effective length and number of shot pellets in the missile propelled from the gun. When used in a smooth gun, very high velocities can be utilized; the weapon is cheaper than rifled versions, and the barrels will last longer. At longer ranges, when normal shotgun buckshot pellets are too dispersed for effectively hitting a target, or damaging a target if it is hit, the fettered shot offers an effective one foot diameter pattern with the striking force of a 437 grain projectile.

The devastation accomplished on a human target increases the psychological effect on enemy troops or police adversaries. When struck in the limbs at the effective range, the result more than likely is complete removal of that limb, and the enemy soldier would be unlikely to return to combat. The threat of such harm would be a significant deterrent in police action directed against criminal activities.

The projectile is effective against helicopters for the reason that it is a foot or more in length, whereas a rifle bullet is approximately one inch or less, depending upon the caliber. For this reason, the fettered shot also would allow soldiers to cut parachute cords and/or rip parachute canopies, which would have a highly destructive and demoralizing effect on remaining airborne troops.

The fettered shot has a 25 to 50 times greater chance of impacting, or becoming entangled in, the rear rotor of a helicopter. Once the rear rotor is lost, disabled, or deformed, the helicopter becomes impossible to control; and if at a high enough altitude, the survival of the passengers upon ground impact would be unlikely. Thus, the enemy not only loses the aircraft but the enemy combat troops are lost or disabled before they are on the ground.

The present invention provides the combat infantryman with a greater degree of success in downing a helicopter; friendly troops are exposed for a lesser period of time to weapons fired from support aircraft, and fast and massive enemy troop movements via helicopter is discouraged.

The fettered shot of this invention can also be used in heavy guns up to 105 and 155 millimeter artillery, as shown in FIGS. 5 and 6. The shell can be loaded with groups of 3 or 4 shot pellets chained together and loaded in multiple groups per shell. Thus, the shell would turn the artillery piece into a highly effective short range (500 to 1000 yards) perimeter defense weapon, particularly in jungle application, and for repelling night-time assaults. Loaded with fettered shot, the shell would be effective against enemy personnel and light vehicles which is an advantage over the present artillery shell loaded with flachettes. These loads are designed for use in rifled artillery as well as smoothbore tank mounted guns. With heavy caliber artillery, the pellet size can be increased substantially to an inch or more, if desired, while retaining the center to center length/diameter of pellet relationship for the fettered shot. Fully automatic large tank mounted guns, firing fettered shot, would be highly effective in killing enemy attack helicopters. In addition, these tank mounted smooth bore guns would be an extremel lethal ground troop weapon.

Some military experts view the helicopter as an unarmored tank and use helicopters to fuel ground tank columns. The use of fettered shot with guns mounted on our tanks and armor will enhance their capability to knock out enemy gun ships and fuelers by shooting heavy projectiles through the rotors.

In intermediate full automatic weapons mounted on jeeps, this capability is further enhanced because many more cartridges could be fired by a highly mobile gunner. Weapons utilizing fettered shot would advantageously be placed at strategic points such as bridges, passes, cross-roads, and the like to repel helicopter and airborne attacks by day and also effectively at night.

The shell of FIG. 5 can be further modified in accordance with FIG. 6, wherein the shot cup 62 is provided with a coextensive cylindrical protector 74. The cup 62 and protector 74 may be provided with longitudinal slots to form radially spaced tabs such as tabs 42 of FIGS. 2 and 4, for example. The protector 74 can be extended into the nose 58 of the shell, if desired, and the small shot 66 can be placed within the cup 62.

It is preferred that the connectors 28, 92 have a mean diameter equal to the shot 26 diameter divided by 1.0 to 2.4. The fettered shot are located on centers spaced apart by an amount equal to the diameter of the shot divided by 0.15 to 0.20 which compensates for the aerodynamatic drag of the connector and produces the desired pattern.

In FIG. 5, the foam pad 62 can be extended into the forwardmost end 68 of the case at 58, thereby protecting the barrel from wear which may otherwise result from the soft lead shot 66.

I claim:

1. A shell for discharging projectiles from a gun comprising:

a tubular main body having a base at a near end and a closure member at the far end thereof; a primer cap supported by the base, an explosion charge in said main body adjacent the primer cap adapted to be exploded when the primer cap is detonated;

an outwardly opening shot cup removably received within said main body at a location adjacent said closure member;

a plurality of individual shot stored within said shot cup, a connecting member by which the individual shot are connected together in a series relationship and thereby become spaced a minimum distance apart and form a linear pattern when the shot are discharged from the main body; a shock absorber positioned between the explosive charge and the shot cup;

said shot cup has a base, a cylindrical skirt affixed to the base of the cup, said skirt member is made of a plurality of circumferential tabs which extend in opposition to the base of the main body; whereby detonation of the primer cap causes the charge to explode, whereupon the shot cup is forced from the main body, and thereafter the shot cup is separated from the shot;

there is a first shot, a last shot, and at least one central shot; attachment means by which said last shot is attached to said shot cup with a force which casues aerodynamic drag to break the attachment means and separate the last shot from the shot cup after the shot cup is forced from the shell.

2. The shell of claim 1 wherein the shot diameter and the spacing between adjacent shot is equal to the shot diameter divided by 0.15 to 0.20.

3. The shell of claim 1 wherein the mean diameter of said connecting member is equal to the diameter of the shot divided by 2.4 to 1.6.

4. A shell for discharging projectiles from a gun comprising:

a tubular main body having a base at a near end and a closure member at the far end thereof; a primer cap supported by the base, an explosion charge in said body adjacent the primer cap adapted to be exploded when the primer cap is detonated;

an outwardly opening shot cup removably received within said main body at a location adjacent said closure member;

a plurality of individual shot stored within said shot cup, a connecting member by which the individual shot are connected together in series relationship and thereby become spaced a minimum distance apart and form a linear pattern when the shot are discharged from the main body; a shock absorber positioned between the explosive charge and the shot cup;

said shot cup has a base, a cylindrical skirt affixed to the base of the cup, said skirt member is made of a plurality of circumferential tabs which extend in opposition to the base of the main body; whereas detonation of the primer cap causes the charge to explode, whereupon the shot cup is forced from the main body, and thereafter the shot cup is separated from the shot;

there is a first shot, a last shot, and at least one central shot; attachment means by which said last shot is attached to said shot cup with a force which causes aerodynamic drag to break the attachment means and separate the last shot from the shot cup after the shot cup is forced from the shell;

wherein the spacing between adjacent shot is equal to the shot diameter divided by 0.15 to 0.02;

wherein the mean diameter of said connecting member is equal to the diameter of the shot divided by 2.4 to 1.6.

5. A cartridge for use in firearms including heavy caliber firearms and artillery; said cartridge having a main body within which there is enclosed a shot cup, a plurality of shot, connection means tying each shot to another shot with all of the shot being arranged in series relationship, said connection means and said shot are enclosed within said shot cup;

a shock absorber, an explosive charge, means for detonating said explosive charge;

said cartridge having a near end and a far end, said explosive charge is positioned within said main body at the near end of the cartridge, said shot is positioned within the main body at the far end of the cartridge, said shock absorbers separates said explosive charge and said shot cup from one another;

wherein the spacing between adjacent shot is equal to the shot diameter divided by 0.15 to 0.20;

wherein the mean diameter of said connecting member is equal to the diameter of the shot divided by 2.4 to 1.6;

wherein there is a first shot, a last shot, and at least one central shot; attachment means by which said last shot is attached to said shot cup with a force which causes aerodynamic drag to break the attachment means and separate the last shot from the shot cup after the shot cup is forced from the shell; whereby:

said shot are projected from the cartridge in a low drag configuration and form a linear pattern.

* * * * *